US010670306B2

(12) United States Patent
Kauppi et al.

(10) Patent No.: US 10,670,306 B2
(45) Date of Patent: Jun. 2, 2020

(54) MECHATRONIC DRIVERS IN THE COLD END OF A HEAT PUMP

(71) Applicant: ThermoLift, Inc., Stony Brook, NY (US)

(72) Inventors: Erik Kauppi, Ann Arbor, MI (US); David Yates, Ann Arbor, MI (US); Peter Hofbauer, West Bloomfield, MI (US); Matthew Duthie, Ann Arbor, MI (US)

(73) Assignee: ThermoLift, Inc., Stony Brook, NY (US)

( * ) Notice: Subject to any disclaimer, the term of this patent is extended or adjusted under 35 U.S.C. 154(b) by 175 days.

(21) Appl. No.: 15/769,142

(22) PCT Filed: Oct. 18, 2016

(86) PCT No.: PCT/US2016/057456

§ 371 (c)(1),
(2) Date: Apr. 18, 2018

(87) PCT Pub. No.: WO2017/070072

PCT Pub. Date: Apr. 27, 2017

(65) Prior Publication Data

US 2018/0313582 A1 Nov. 1, 2018

Related U.S. Application Data

(60) Provisional application No. 62/244,133, filed on Oct. 20, 2015.

(51) Int. Cl.
*F25B 9/14* (2006.01)
*F25B 30/02* (2006.01)

(52) U.S. Cl.
CPC ..... *F25B 9/14* (2013.01); *F25B 30/02* (2013.01)

(58) Field of Classification Search
CPC ..... F25B 9/10; F25B 9/14; F25B 2309/023; F25B 2309/1428
See application file for complete search history.

(56) References Cited

U.S. PATENT DOCUMENTS 5,056,317 A 10/1991 Stetson
5,251,448 A 10/1993 Rodger
(Continued)

FOREIGN PATENT DOCUMENTS

DE 4206958 A1 9/1993
GB 1108097 A * 4/1968 ..... F02G 1/0435
(Continued)

OTHER PUBLICATIONS

DE4206958 Translation (Year: 1993).*

*Primary Examiner* — Brian M King
(74) *Attorney, Agent, or Firm* — Diana D. Brehob

(57) ABSTRACT

Some heat pumps have displacers mechatronically-controlled via springs and coils acting upon a ferromagnetic plate. In some prior art heat pumps, the components are housed in hot parts of the heat pump and in others, the components are housed in a cold part of the heat pump, but the components are offset from a central axis of the heat pump. A heat pump with the mechatronic driver components collinear with a central axis of the heat pump has the components in a cold part of the heat pump.

18 Claims, 5 Drawing Sheets

(56) References Cited

U.S. PATENT DOCUMENTS

| | | | | |
|---|---|---|---|---|
| 5,596,875 | A * | 1/1997 | Berry | F16F 7/1005<br>62/520 |
| 6,345,666 | B1 * | 2/2002 | Conrad | F02G 1/0435<br>165/141 |

FOREIGN PATENT DOCUMENTS

| | | | |
|---|---|---|---|
| JP | 07-269968 | A | 10/1995 |
| JP | 07-269969 | A | 10/1995 |
| JP | 08-049927 | A | 2/1996 |
| JP | 09-151790 | A | 6/1997 |

* cited by examiner

MECHATRONIC DRIVERS IN THE COLD END OF A HEAT PUMP

FIELD

The present disclosure relates to a mechatronic assembly used to drive displacers in a heat pump.

BACKGROUND

A Vuilleumier heat pump (VHP) is a thermodynamic apparatus in which thermal energy from a source, such as a combustor, as well as energy from the environment is extracted to provide heating. The amount of energy available for heating is greater than the amount of fuel energy supplied to the combustor because it is supplemented by the energy from the environment.

VHPs have been built with a crank system that couples two displacers, an example VHP 10 is shown in FIG. 1. A crank 16 is used to start the reciprocation of the hot displacer 12 and the cold displacer 14. Displacers 12 and 14 reciprocate in a cylinder 26 that is within a housing 18. Displacer 12 and 14 separate the volume within cylinder 26 into three volumes: a hot volume 20, a warm volume 22, and a cold volume 24. The mass of the crank 16, optionally with a flywheel maintains the displacer reciprocation, even when forces acting upon the displacers 12 and 14 might otherwise cause the displacers to fail to reciprocate to its end of travel.

In a system disclosed in commonly-assigned patent application U.S. 2015/0075209, displacers are caused to move between ends of travel by a spring acting on the displacer as shown in FIG. 2. A heat pump 250 has a housing 252. A cylinder 254 is provided in housing 252. A hot displacer 262, which can reciprocate within cylinder 254 is at its lowest point of travel. A cold displacer 266, which can also reciprocate within cylinder 254 is at its high point of travel. The displacers define three chambers: a hot chamber 272, a warm chamber, and a cold chamber 276. With the positions of displacers 262 and 266 as illustrated in FIG. 2, the warm chamber has no volume and is thus not provided a numeral. Housing 252 has a hot end 282 and a cold end 286. Energy is provided by an energy source 290 to the hot end of heat pump 250. Energy source may be a burner and may be supplemented by solar energy.

A post 288 is affixed to the cold end 286 of housing 252 and extends into housing 252 along a central axis of housing 252. Post 288 extends through cold displacer 266 and extends into one end of hot displacer 262. Post 288 has electromagnets 292*a* and 292*c* disposed within hot displacer 262 and electromagnets 296*a* and 296*c* disposed within cold displacer 266.

Ferromagnetic elements or blocks 222*a*, 222*b*, and 222*c* are affixed to hot displacer 262. Blocks 222*a*, 222*b*, and 222*c* are displaced from each other by predetermined distances as measured in a direction along the axis of housing 252. The predetermined distances are related to the desired travel of hot displacer 262. Ferromagnetic blocks 226*a*, 226*b*, and 226*c* are affixed to cold displacer 266. Blocks 226*a*, 226*b*, and 226*c* are displaced from each other by predetermined distances as measured in a direction along the axis of housing 252.

It has been found that coil 292*a* that is the closest to energy source 290 becomes too hot to operate properly. Thus, the mechatronics driving system should be moved to a cooler portion of heat pump 250.

In DE 4206958 A1, mechatronics 60 of a Vuilleumier heat pump 50 is disposed in the cold end of the heat pump. Heat pump 50 has a cylinder 52 in which a hot displacer 54 and a cold displacer 56 reciprocate. Heat pump 50 has a burner 58 or other suitable energy source. Hot displacer 54 is coupled to a ferromagnetic arm 84 that is disposed between two coils 80 and 82. Coils 80 and 82 are surrounded by spring 86 and 88, respectively. Hot displacer 54 is in its upward end of travel as shown by spring 86 being substantially fully compressed. Coil 80 is holding ferromagnetic arm 84 at the position shown. When, coil 80 is commanded to release arm 84, hot displacer 54 and arm 84 will move downward from the force of spring 86. At such time spring 88 would become compressed and to hold hot displacer in its downward end of travel, coil 82 would be commanded to exert first a grabbing attractive force and after arm 84 is proximate coil 82, a holding force.

Cold displacer 56 is shown at its lower end of travel in FIG. 3. A ferromagnetic arm 74 is coupled to cold displacer 54 and transmits forces acting on arm 74 to cold displacer 56. A coil 76 is above arm 74. Coil 76 can be commanded to attract arm 74. Spring 76 and 78 act upon arm 74 to cause cold displacer 56 to move from one end of travel to the other end of travel. However, due to losses in the system and other forces acting upon cold displacer 56, cold displacer 56 can fail to reach the end of travel (or in other undesirable instances, hits when it gets to the other end of travel). The appropriate one of coils 70 and 72 is energized to attract ferromagnetic arm 74 to grab and then hold arm 74. As arm 74 is coupled to cold displacer 56, such action holds cold displacer 56 in place.

The configuration in FIG. 3 is chosen because it minimizes that length taken up by the mechatronics 60. However, because everything is off-center, some cocking can occur. Furthermore, assembling items that are off-center can present challenges to maintain desired assembly accuracy.

SUMMARY

To overcome at least one problem in the prior art, a mechatronics system in which the components are centrally located is disclosed. In one embodiment, a heat pump has: a housing having a thermodynamic process portion coupled to a mechatronic driver portion, a cylinder disposed within the housing in the thermodynamic process portion of the housing, a hot displacer disposed within the cylinder and adapted to reciprocate within the cylinder, a hot-displacer rod coupled to the hot displacer, a hot-displacer ferromagnetic plate coupled to the hot-displacer rod, a hot-displacer spring coupled to the hot-displacer ferromagnetic plate, and an upper hot-displacer coil and a lower hot-displacer coil that are proximate with the upper hot-displacer coil proximate a face of the hot-displacer plate that faces the hot displacer and the lower hot-displacer coil proximate a face of the hot-displacer plate that faces away from the hot displacer. The hot-displacer plate, upper hot-displacer coil, the lower hot-displacer coil, and the hot-displacer spring are disposed within the mechatronic driver portion of the housing. The hot-displacer rod runs through the hot-displacer spring.

In some embodiments, the heat pump also has a cold displacer disposed within the cylinder and adapted to reciprocate within the cylinder, a cold-displacer rod coupled to the cold displacer, a cold-displacer ferromagnetic plate coupled to the cold-displacer rod, a cold-displacer spring coupled to the cold-displacer ferromagnetic plate, and an upper cold-displacer coil and a lower cold-displacer soil that are proximate with the upper cold-displacer coil proximate a face of the cold-displacer plate that faces the cold displacer and the lower cold-displacer coil proximate a face of the cold-displacer plate that faces away from the cold displacer. The cold-displacer plate, upper cold-displacer coil, the lower cold-displacer coil, and the cold-displacer spring disposed within the mechatronic driver portion of the housing. The cold-displacer rod runs through the cold-displacer spring.

The cold-displacer spring is closer to the thermodynamic cycle portion of the housing than the hot-displacer spring.

The cold-displacer rod is hollow. The hot-displacer rod runs through the cold-displacer rod.

The hot-displacer spring is in tension when the hot displacer is at one end of its travel and is in compression when the hot displacer is at the other end of its travel.

The hot-displacer spring is an upper hot-displacer spring that is on one side of the hot-displacer ferromagnetic plate, the heat pump also includes a lower hot-displacer spring that is on the other side of the hot-displacer ferromagnetic plate with respect to the upper hot-displacer spring.

The heat pump further includes an electronic control unit electronically coupled to the upper hot-displacer coil and the lower hot-displacer coil. The electronic control unit provides actuation signals to the coils.

The electronic control unit bases control of the coils on at least one of a user input and a sensor coupled to the heat pump and electronically coupled to the electronic control unit.

A central axis of the cylinder disposed within the housing is collinear with a central axis of the hot-displacer rod, a central axis of the hot displacer, a central axis of the hot-displacer ferromagnetic plate, a central axis of the hot-displacer spring, a central axis of the upper hot-displacer coil, and a central axis of the lower hot-displacer coil.

Also disclosed is a heat pump that has a housing having a thermodynamic process portion coupled to a mechatronic driver portion; first and second cylinder portions disposed within the housing collinearly along a central axis; a hot displacer disposed within the first cylinder portion and adapted to reciprocate within the first cylinder portion; a cold displacer disposed with the second cylinder portion and adapted to reciprocate with the second cylinder portion; a hot chamber delimited by the housing, the first cylinder portion, and the hot displacer; a warm chamber delimited by the housing, the first and second cylinder portions, the hot displacer, and the cold displacer; a cold chamber delimited by the housing, the second cylinder portion, and the cold displacer; an upper cold-displacer coil disposed in the mechatronic driver portion of the housing; a lower cold-displacer coil disposed in the mechatronic driver portion of the housing; and a cold-displacer ferromagnetic plate disposed between the upper and lower cold-displacer coils. The upper and lower cold-displacer coils are collinear with the central axis of the central axis.

The heat pump further includes an upper hot-displacer coil disposed in the mechatronic driver portion of the housing, a lower hot-displacer coil disposed in the mechatronic driver portion of the housing, and a hot-displacer ferromagnetic plate disposed between the upper and lower hot-displacer coils. The upper and lower hot-displacer coils are collinear with the central axis of the central axis.

The heat pump also has a cold-displacer rod coupled between the cold displacer and the cold-displacer ferromagnetic plate and a hot-displacer rod coupled between the hot displacer and the hot-displacer ferromagnetic plate.

The cold-displacer rod and the hot-displacer rod are collinear with the central axis. One of the cold-displacer rod and the hot-displacer rod is hollow to allow the other to move within the rod that is hollow.

The heat pump further includes a cold displacer spring that is coupled to the cold-displacer ferromagnetic plate on one end and a hot displacer spring that is coupled to the hot-displacer ferromagnetic plate on one end. A central axis of the hot displacer spring and a central axis of the cold displacer spring are collinear with the central axis of the first and second cylinders.

The heat pump also has an electronic control unit electronically coupled to the upper hot-displacer coil and the lower hot-displacer coil. The electronic control unit provides actuation signals to the coils based on at least one signal received by the electronic control unit from a sensor associated with the heat pump.

The coils associated with the hot displacer are farther from the hot displacer than the coils associated with the cold displacer.

The coils associated with the cold displacer are farther from the hot displacer than the coils associated with the hot displacer.

DETAILED DESCRIPTION OF DRAWINGS

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
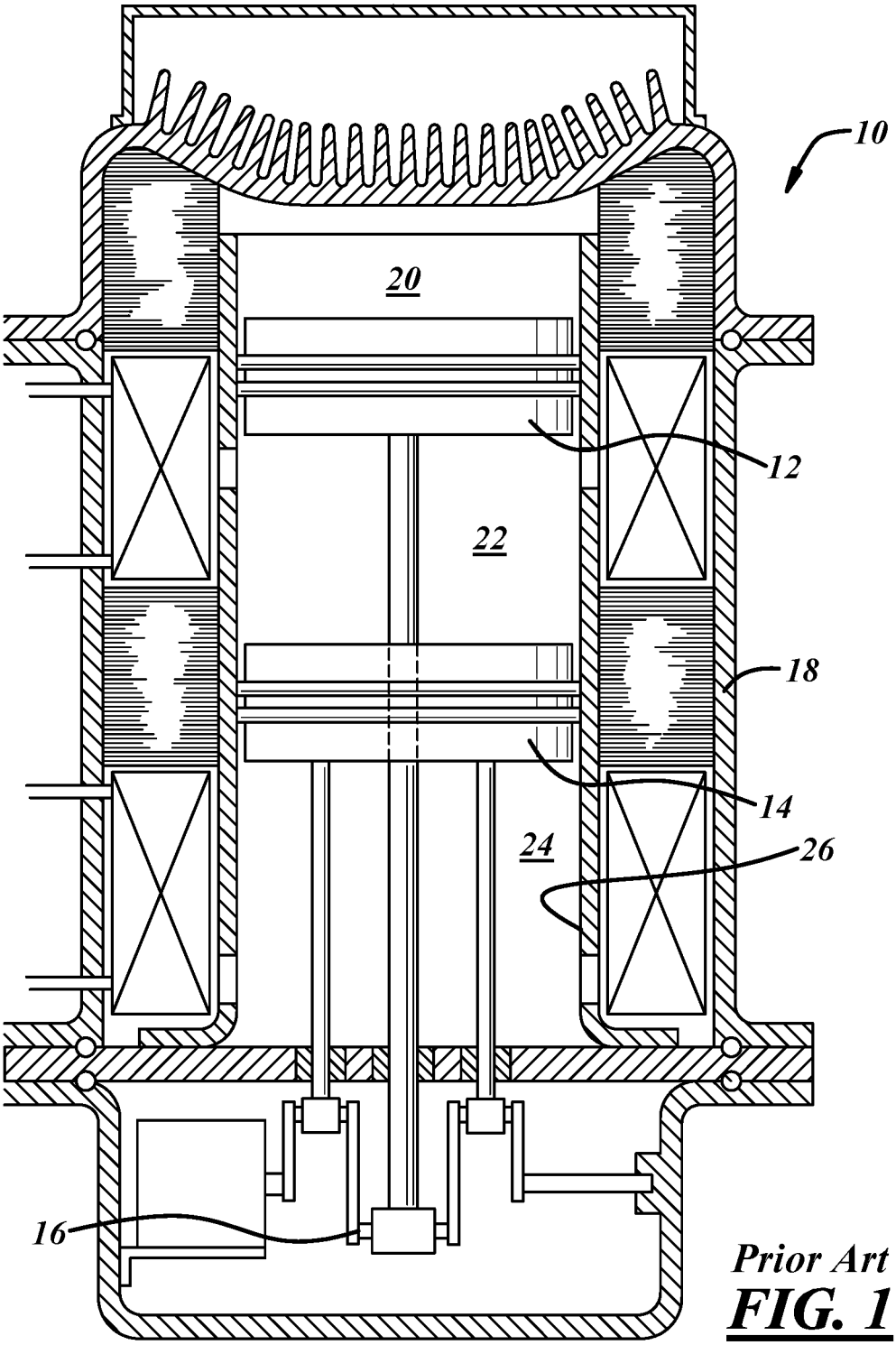
Prior Art FIG. 1
FIG. 1 is a sectioned illustration of a prior art Vuilleumier heat pump.
Figure 2:
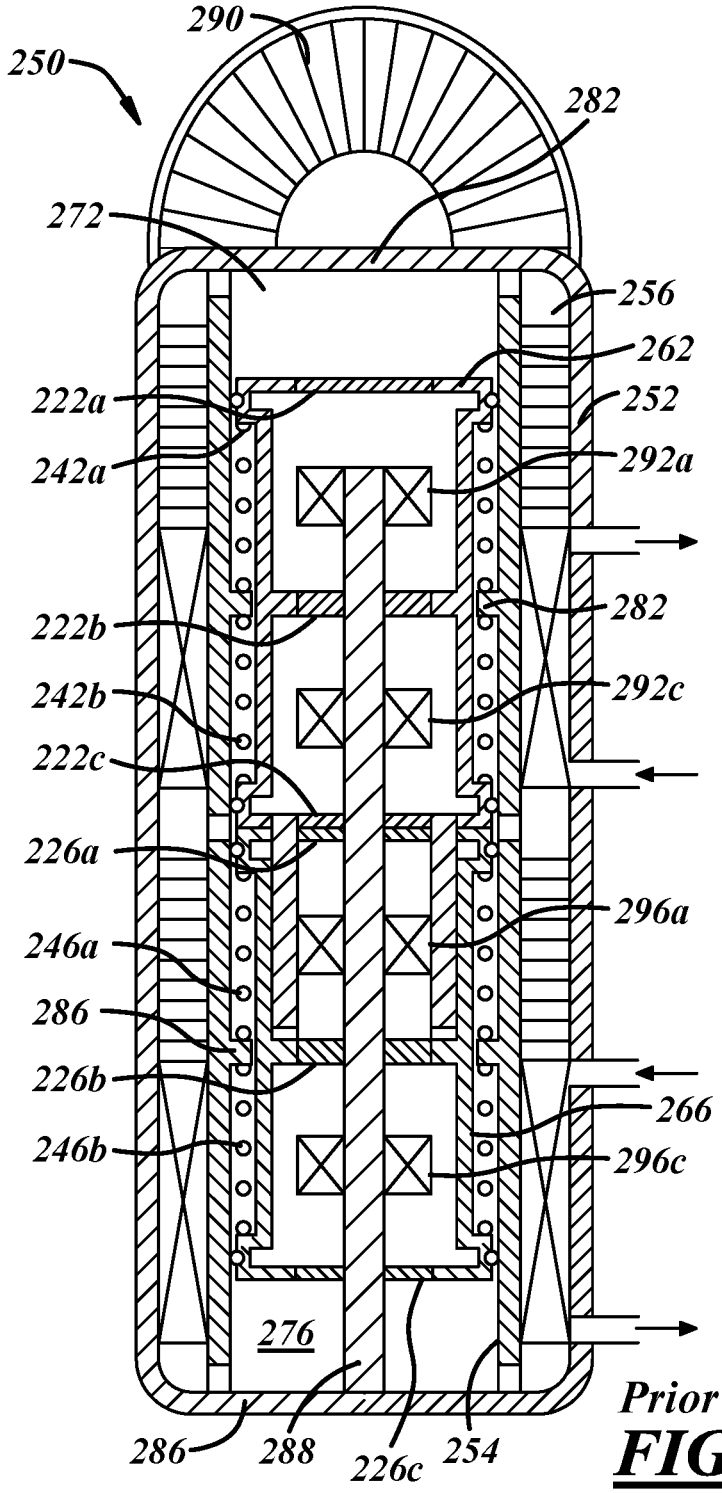
Prior Art FIG. 2
FIG. 2 is a sectioned illustration of a Vuilleumier heat pump with a mechatronic driving system having the coil and spring proximate its associated displacer.
Figure 3:
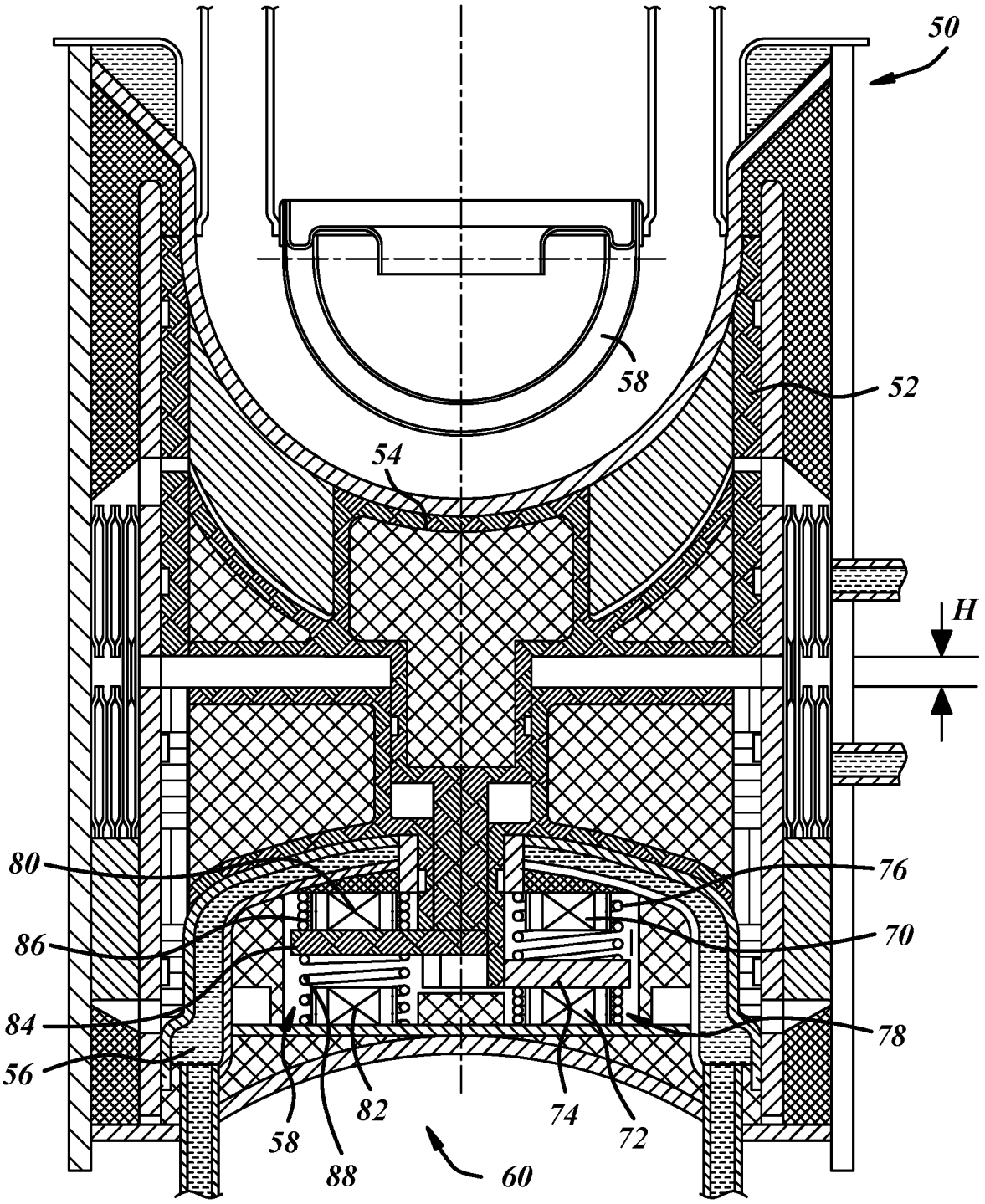
Prior Art FIG. 3
FIG. 3 is a sectioned illustration of a prior art Vuilleumier heat pump in which the mechatronics components are housed within a cool end of the heat pump.
Figure 4:
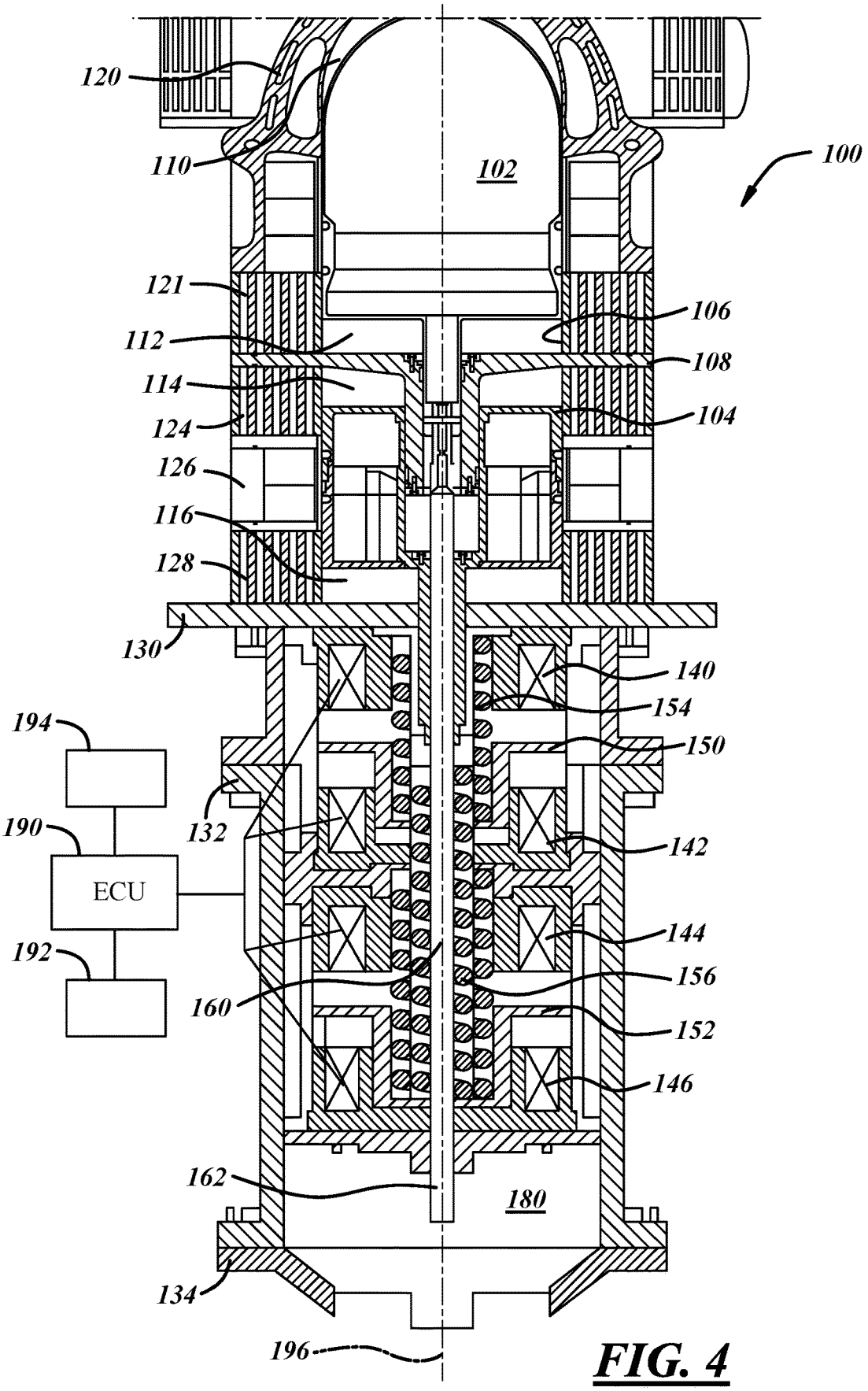
FIGS. 4 and 5 are sectioned illustrations of a Vuilleumier heat pump according to embodiments of the disclosure.

A portion of a heat pump 100 is shown in a section view in FIG. 4. A hot displacer 102 and a cold displacer 104 are disposed within a cylinder 106. In FIG. 4, cylinder 106 comprises two parts, a hot displacer cylinder and a cold displacer cylinder as it is separated by a bridge 108. Displacers 102 and 104 separate the various chambers of the heat pump: a hot chamber 110 above hot displacer 102, a warm hot chamber 112 below hot displacer 102 and above bridge 108, a warm cold chamber 114 above cold displacer 104 an below bridge 108, and a cold chamber 116 below cold displacer 104. Hot and cold displacers 102 and 104 are in a central position between their end points of travel in FIG. 4. The amount of volume in each of chambers 110, 112, 114, and 116 depend on the positions of their associated displacer.

A housing of heat pump 100 includes a number of sections: a dome housing section 120, a hot heat exchanger housing section 122, a section heat exchanger housing section 124, a metallic ring housing section 126 that contains a regenerator, a warm heat exchanger housing section 128, an upper mechatronics housing section 130, a main mechatronics housing section 132, and a mechatronics cap section 134. Bridge 108 is sandwiched between housing sections 122 and 124. Housing sections can be apportioned between a thermodynamic cycle portion that includes sections 120, 122, 124, 126, and 128, and a mechatronic driver portion that includes sections 130, 132, and 134.

Hot displacer 102 is coupled to the lower section of the mechatronic driver that includes a spring 156, and two coils 144 and 146 disposed on either side of a ferromagnetic plate 152. When coil 144 is commanded to attract plate 152 moves upward, through rod 162 that is coupled to plate 152, hot displacer 102 moves upward. Hot displacer 102 moves downward when plate 152 is attracted to coil 146 when coil 146 is energized.

Cold displacer is coupled to the upper section of the mechatronic driver that includes spring 154 and two coils 140 and 142. A ferromagnetic plate 150 is disposed between coils 140 and 142. Plate 152 and, hence, cold displacer 104 move to their upper position when coil 140 is energized to attract plate 152. Plate 152 and cold displacer 104 move to their lower position when coil 152 is energized to attract 152. Cold displacer is coupled to ferromagnetic plate 150 via a hollow rod 160. Rod 162 associated with hot displacer 102 move independently of rod 160 associated with cold displacer 104. Rod 160 moves through the hollow opening of rod 162.

An open volume 180 is disposed in housing section 132 below spring 156 to provide room for rod 162 to reciprocate.

In FIG. 4, a single spring 154 is associated with the upper section of the mechatronic driver. Instead of a single spring 154 that goes between tension and compression when its associated displacer moves from one end of travel to the other end of travel, in an alternative embodiment, two springs both in compression are used with one on one acting on one side of ferromagnetic plate 150 and the other acting on the other side of plate 150.

In FIG. 4, hot displacer 102 is associated with the lower mechatronic driver: plate 152, coils 144 and 146, and spring 156. In an alternative embodiment, hot displacer 102 is associated with the upper mechatronic driver: plate 15, coils 140 and 142, and spring 156. The geometry of the rods would change concomitantly to accommodate such an alternative arrangement. A central axis 196 of heat pump 100 is collinear with a center of cylinder 106, displacer 100, 102, housing sections, springs 154 and 156, coils 140, 142, 144, and 146, ferromagnetic plates 150 and 152.

Continuing to refer to FIG. 4, an electronic control unit (ECU) 190 is coupled to coils 140, 142, 144, and 146. Additionally, electronic drivers can be included in the ECU or as a separate component (not shown in FIG. 4). Actuation signals are provided by ECU 190 to coils to grab or hold the associated ferromagnetic plate. ECU 190 bases the actuation on user inputs 192 and signals from various sensors 194 that may include ambient temperature, temperatures in heat pump 100, position of the displacers (or magnetic plates), pressures within heat pump 100, current draw, as a non-limiting list of example parameters that might be measured via sensors.

Figure 5:
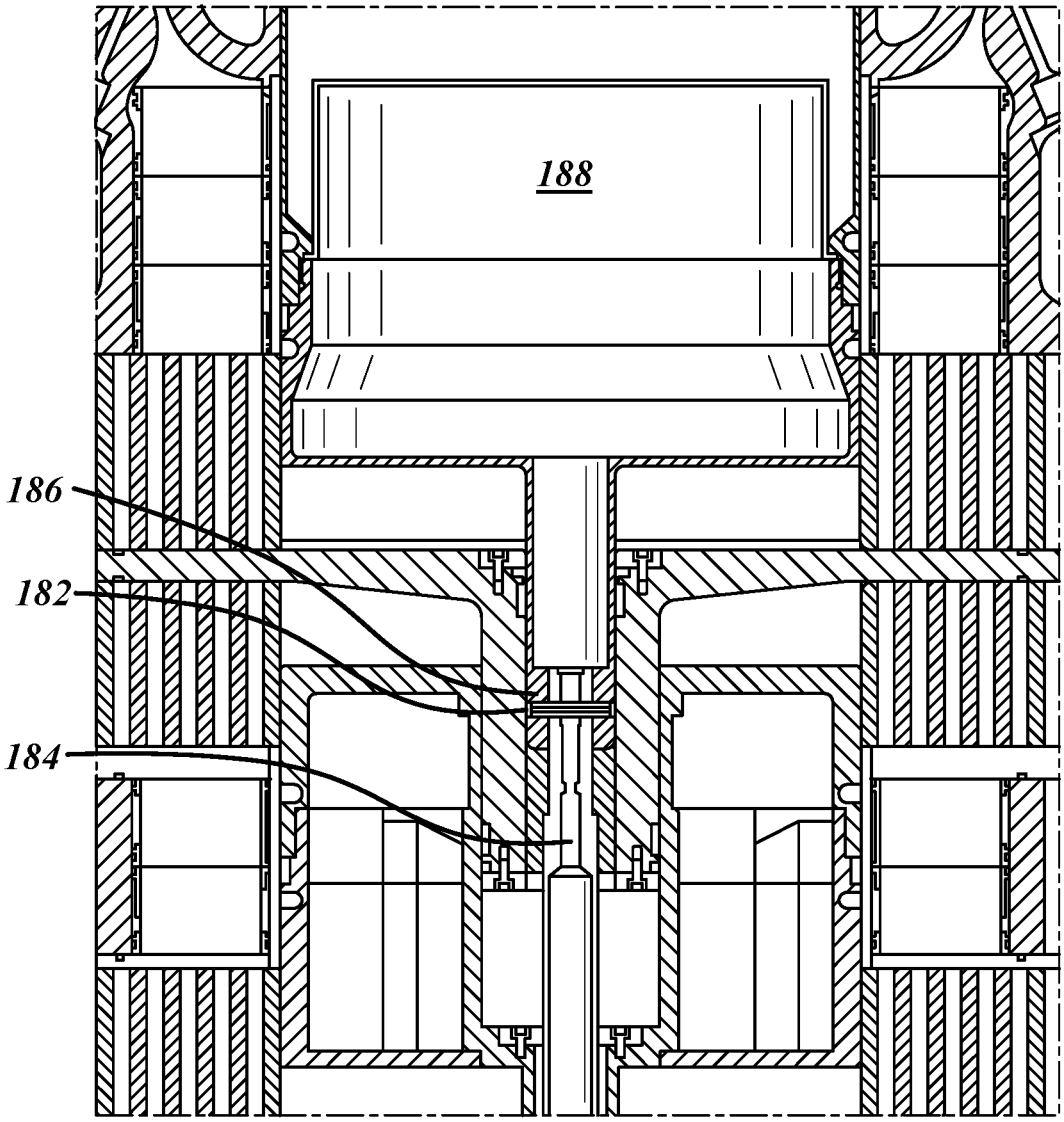

In FIG. 5, a pin 182 is placed between a rod 184 and a plunger 186 that is coupled to a hot displacer 188. Via pin 182 and rod 184, hot displacer 188 is coupled to a ferromagnetic plate of a mechatronic driver (not visible in FIG. 5).

Referring back to FIG. 4, ferromagnetic plate 150 is in the form of a plate near its periphery, the section of plate 150 upon which coils 140 and 142 act. However, plate 150 has a cup its central portion in which spring 154 rests. In an alternative embodiments, plate 150 is a plate without such a cup. For convenience, the term plate is used to denote either a configuration as in FIG. 4 in which plate 150 has a cup or such an alternative plate that doesn't deviate from a typical plate configuration.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art with respect to one or more characteristics are not outside the scope of the disclosure and may be desirable for particular applications.

We claim:

1. A heat pump, comprising:

a housing comprised of a thermodynamic process portion coupled to a mechatronic driver portion;

a cylinder disposed within the housing in the thermodynamic process portion of the housing;

a hot displacer disposed within the cylinder and adapted to reciprocate within the cylinder;

a hot-displacer rod coupled to the hot displacer;

a hot-displacer ferromagnetic plate coupled to the hot-displacer rod;

a hot-displacer spring coupled to the hot-displacer ferromagnetic plate;

an upper hot-displacer coil and a lower hot-displacer coil with the upper hot-displacer coil proximate a face of the hot-displacer plate that faces the hot displacer and the lower hot-displacer coil proximate a face of the hot-displacer plate that faces away from the hot displacer;

a cold displacer disposed within the cylinder and adapted to reciprocate within the cylinder;

a cold-displacer rod coupled to the cold displacer;

a cold-displacer ferromagnetic plate coupled to the cold-displacer rod;

a cold-displacer spring coupled to the cold-displacer ferromagnetic plate; and an upper cold-displacer coil and a lower cold-displacer soil with the proximate with the upper cold-displacer coil proximate a face of the cold-displacer plate that faces the cold displacer and the lower cold-displacer coil proximate a face of the cold-displacer plate that faces away from the cold displacer, wherein:

the hot-displacer plate, upper hot-displacer coil, the lower hot-displacer coil, and the hot-displacer spring are disposed within the mechatronic driver portion of the housing:

the hot-displacer rod runs through the hot-displacer spring;

the cold-displacer plate, upper cold-displacer coil, the lower cold-displacer coil, and the cold-displacer spring disposed within the mechatronic driver portion of the housing;

the cold-displacer rod runs through the cold-displacer spring; and the cold-displacer spring is closer to the thermodynamic cycle portion of the housing than the hot-displacer spring.

2. The heat pump of claim 1 wherein:

the cold-displacer rod is hollow; and the hot-displacer rod runs through the cold-displacer rod.

3. The heat pump of claim 1 wherein the hot-displacer spring is in tension when the hot displacer is at one end of travel of the hot displacer; and the hot-displacer spring is in compression when the hot displacer is at the other end of travel of the hot displacer.

4. The heat pump of claim 1 wherein the hot-displacer spring is an upper hot-displacer spring that is on one side of the hot-displacer ferromagnetic plate, the heat pump further comprising:

a lower hot-displacer spring that is on the other side of the hot-displacer ferromagnetic plate with respect to the upper hot-displacer spring.

5. The heat pump of claim 1, further comprising:

an electronic control unit electronically coupled to the upper hot-displacer coil and the lower hot-displacer coil, wherein:

the electronic control unit provides actuation signals to the upper and lower hot-displacer coils; and when the lower hot-displacer coil is actuated, the lower hot-displacer coil attracts the hot-displacer ferromagnetic plate which is coupled to the hot displacer via a hot-displacer rod thereby causing the hot displacer to move downward.

6. The heat pump of claim 5 wherein the electronic control unit bases control of the coils on at least one of a user input and a sensor coupled to the heat pump and electronically coupled to the electronic control unit.

7. The heat pump of claim 1 wherein a central axis of the cylinder disposed within the housing is collinear with a central axis of the hot-displacer rod, a central axis of the hot displacer, a central axis of the hot-displacer ferromagnetic plate, a central axis of the hot-displacer spring, a central axis of the upper hot-displacer coil, and a central axis of the lower hot-displacer coil.

8. The heat pump of claim 1 wherein the cylinder is comprised of multiple sections coupled together.

9. A heat pump, comprising:

a housing comprised of a thermodynamic process portion and a mechatronic driver portion;

first and second cylinder portions disposed within the housing collinearly along a central axis;

a hot displacer disposed within the first cylinder portion and adapted to reciprocate within the first cylinder portion;

a cold displacer disposed with the second cylinder portion and adapted to reciprocate with the second cylinder portion;

a hot chamber delimited by the housing, the first cylinder portion, and the hot displacer;

a warm chamber delimited by the housing, the first and second cylinder portions, the hot displacer, and the cold displacer;

a cold chamber delimited by the housing, the second cylinder portion, and the cold displacer; and an upper cold-displacer coil disposed in the mechatronic driver portion of the housing;

a lower cold-displacer coil disposed in the mechatronic driver portion of the housing;

a cold-displacer ferromagnetic plate disposed between the upper and lower cold-displacer coils wherein central axes of the upper and lower cold-displacer coils are collinear with a central axis of the mechatronic driver portion of the housing;

a cold-displacer rod coupled between the cold displacer and the cold-displacer ferromagnetic plate; and a hot-displacer rod coupled between the hot displacer and the hot-displacer ferromagnetic plate wherein:

the cold-displacer rod and the hot-displacer rod are collinear with the central axis; and one of the cold-displacer rod and the hot-displacer rod is hollow to allow the other to move within the rod that is hollow.

10. The heat pump of claim 9, further comprising:

an upper hot-displacer coil disposed in the mechatronic driver portion of the housing;

a lower hot-displacer coil disposed in the mechatronic driver portion of the housing; and a hot-displacer ferromagnetic plate disposed between the upper and lower hot-displacer coils wherein the upper and lower hot-displacer coils are collinear with the central axis of the central axis.

11. The heat pump of claim 9, further comprising:

a cold displacer spring that is coupled to the cold-displacer ferromagnetic plate on one end; and a hot displacer spring that is coupled to the hot-displacer ferromagnetic plate on one end wherein a central axis of the hot displacer spring and a central axis of the cold displacer spring are collinear with the central axis of the first and second cylinders.

12. The heat pump of claim 10, further comprising:

an electronic control unit electronically coupled to the upper hot-displacer coil and the lower hot-displacer coil wherein the electronic control unit provides actuation signals to the coils based on one or more signals received by the electronic control unit.

13. The heat pump of claim 10 wherein the coils associated with the hot displacer are farther from the hot displacer than the coils associated with the cold displacer.

14. The heat pump of claim 10 wherein the coils associated with the cold displacer are farther from the hot displacer than the coils associated with the hot displacer.

15. The heat pump of claim 9 wherein:

the warm chamber is comprised of a warm hot chamber and a warm cold chamber;

the heat pump further comprises a bridge that separates the warm hot chamber from the warm cold chamber;

the warm hot chamber is delimited by the first cylinder portion, the hot displacer and the bridge; and the warm cold chamber is delimited by the second cylinder portion, the cold displacer, and the bridge.

16. A heat pump, comprising:

a housing comprised of a thermodynamic process portion and a mechatronic driver portion;

first and second cylinder portions disposed within the housing collinearly along a central axis;

a hot displacer disposed within the first cylinder portion and adapted to reciprocate within the first cylinder portion;

a cold displacer disposed with the second cylinder portion and adapted to reciprocate with the second cylinder portion;

a hot chamber delimited by the housing, the first cylinder portion, and the hot displacer;

a warm chamber delimited by the housing, the first and second cylinder portions, the hot displacer, and the cold displacer;

a cold chamber delimited by the housing, the second cylinder portion, and the cold displacer; and an upper cold-displacer coil disposed in the mechatronic driver portion of the housing;

a lower cold-displacer coil disposed in the mechatronic driver portion of the housing;

a cold-displacer ferromagnetic plate disposed between the upper and lower cold-displacer coils wherein central axes of the upper and lower cold-displacer coils are collinear with a central axis of the mechatronic driver portion of the housing;

a cold-displacer rod coupled between the cold displacer and the cold-displacer ferromagnetic plate; and a hot-displacer rod coupled between the hot displacer and the hot-displacer ferromagnetic plate wherein:

a cold displacer spring that is in contact with the cold-displacer ferromagnetic plate on one end; and a hot displacer spring that is in contact with the hot-displacer ferromagnetic plate on one end wherein a central axis of the hot displacer spring and a central axis of the cold displacer spring are collinear with the central axis of the first and second cylinders.

17. The heat pump of claim 15, wherein:

the cold-displacer spring alternates between tension and compression when the cold displacer reciprocates between ends of travel in the second cylinder portion; and the hot-displacer spring alternates between tension and compression when the hot displacer reciprocates between ends of travel in the first cylinder portion.

18. The heat pump of claim 15, wherein:

the cold-displacer spring comprises first and second compression springs each of which act on the cold-displacer ferromagnetic plate;

first and second compression springs are biased against each other;

the hot-displacer spring comprises third and fourth compression springs each of which act on the hot-displacer ferromagnetic plate; and third and fourth compression spring are biased against each other.

* * * * *